United States Patent [19]

Krusche

[11] 3,954,247

[45] May 4, 1976

[54] MIRROR MOUNTING

[75] Inventor: Kurt Krusche, Frankfurt am Main, Germany

[73] Assignee: Allstar Verbrauchsguter GmbH & Co. KG., Frankfurt am Main, Germany

[22] Filed: May 1, 1974

[21] Appl. No.: 466,020

[30] Foreign Application Priority Data

May 8, 1973 Germany ..... 2323039

[52] U.S. Cl. ..... 248/471; 248/121; 248/127

[51] Int. Cl.[2] ..... A47F 7/14; A47G 79/00

[58] Field of Search ..... 350/245, 246, 251, 252, 350/256, 308, 309; 219/227, 240, 242; 248/37.3, 37.6, 40, 44, 176, 51, 52, 74, 185, 126, 223, 224, 466–489; 211/60 R, 60 M, 60 T, 69.1–69.9

[56] References Cited

UNITED STATES PATENTS

| | | | |
|---|---|---|---|
| 1,909,662 | 5/1933 | Conners | 350/256 X |
| 2,161,855 | 6/1939 | Copell | 211/60 M X |
| 2,295,176 | 9/1942 | Kelly | 240/4.2 X |
| 2,414,223 | 1/1947 | DeVirgilis | 240/4.2 |
| 2,503,801 | 4/1950 | Clarke | 248/185 X |
| 3,032,879 | 5/1962 | Lafitte | 350/308 X |
| 3,385,551 | 5/1968 | McKay | 248/472 X |
| 3,536,281 | 10/1970 | Meehan et al. | 248/223 X |
| 3,648,836 | 3/1972 | Castner | 211/60 R X |
| 3,710,096 | 1/1973 | McFarlin | 248/223 X |

FOREIGN PATENTS OR APPLICATIONS

| | | | |
|---|---|---|---|
| 1,135 | 1/1913 | United Kingdom | 248/474 |

*Primary Examiner*—Roy D. Frazier
*Assistant Examiner*—Terrell P. Lewis
*Attorney, Agent, or Firm*—Kurt Kelman

[57] ABSTRACT

A mounting for a mirror comprises a handle having one end attached to the mirror frame and a holder bracket consisting of two essentially plate-like arms enclosing an angle with each other. A first bracket arm has a free end defining an outwardly open recess receiving a peripheral groove in the one handle end, and a second bracket arm defines a substantially flat support surface whereby the mirror may be used as a hand mirror, a wall mirror or a standing mirror.

6 Claims, 4 Drawing Figures

MIRROR MOUNTING

The present invention relates to improvements in a mounting for a mirror held in a frame to permit the mirror to be used as a hand mirror, a wall mirror or a standing mirror. If desired, the mirror may be illuminated.

Mirrors of various types are on the market. Hand mirrors are provided with a handle having one end attached to the mirror frame. Wall mirrors have brackets and fastening means attaching the bracket to the wall and standing mirrors have brackets adapted to stand on a supporting surface. It is also known to provide wall and standing mirrors with illumination.

It is the primary object of this invention to provide a mounting for a mirror enabling the same to be used as a hand mirror, with or without illumination, as well as a wall or standing mirror.

The above and other objects are accomplished in accordance with the invention with a mounting comprising a handle having one end attached to the mirror frame and a holder bracket consisting of two essentially plate-shaped arms enclosing an angle with each other. The one handle end defines a relatively deep peripheral groove and the holder bracket has a first bracket arm having a free end defining an outwardly open recess adapted to receive the peripheral groove of the one handle end and to form a seat for this grooved handle end, and a second bracket arm defining a substantially flat support surface.

According to a preferred feature of the present invention, the bracket arms are hollow bodies of synthetic resin or metal.

The above and other objects, advantages and features of this invention will become more apparent from the following detailed description of a now preferred embodiment thereof, taken in conjunction with the accompanying drawing wherein FIG. 1 is a side elevational view of a mirror whose handle is mounted in a holder bracket, the bracket being shown partly in section;

Figures 1, 2:
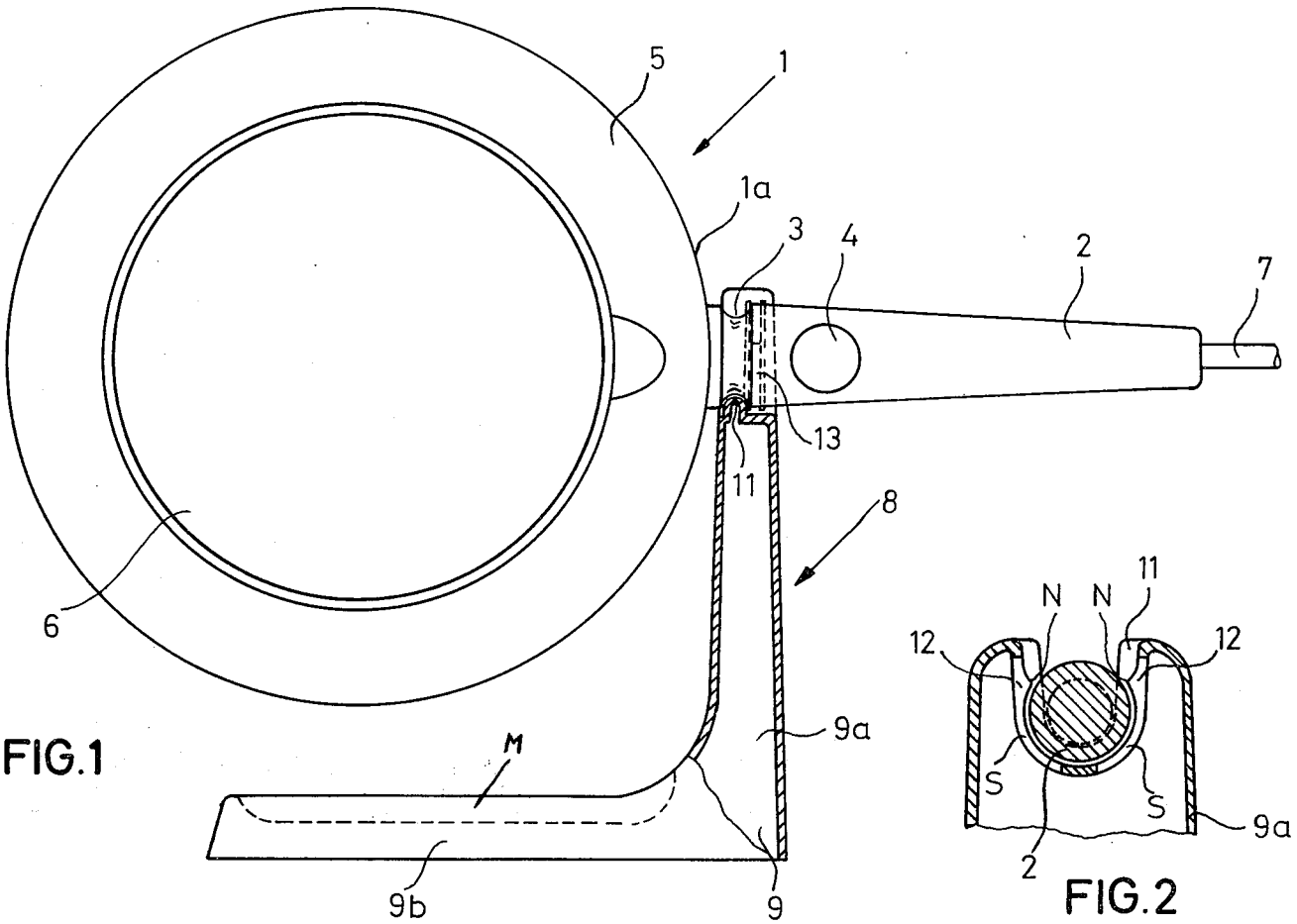
FIG. 2 shows a transverse cross section of the one handle end received in the open recess of the one bracket arm.

Referring now to the drawing and first to FIG. 1, there is shown mirror 1 whose handle 2 is removably held in recess 10 of first bracket arm 9*a* of holder bracket 8. In the illustrated embodiment, frame 1*a* and mirror insert 6 of the mirror are circular. One end of handle 2 is attached to mirror frame 1*a* and defines a relatively deep peripheral groove 3. The mirror insert is removably mounted on the frame which concentrically surrounds the mirror insert and defines an annular gap therewith. The wall of the mirror frame is arcuately shaped to define a concave rim portion 5 facing mirror insert 6 and a light bulb (not shown) may be mounted behind the mirror insert in the frame, light from this bulb passing through the annular gap and being reflected by the portion 5 onto the face of a viewer. An electrical cable 7 passes through handle 2 from the socket of the light bulb and electric switch 4 is mounted on the handle to operate the bulb.

Preferably, the mirror insert has two mirror faces, one of them being a concave mirror and the other face being a flat mirror. Both mirror faces may be used not only as a hand mirror but also as a wall or standing mirror since the mirror insert held in the holder bracket may be rotated about the axis of handle 2. This pivotal mounting of the mirror insert enables the same to be used at the most favorable angle.

Holder 8 is constituted by bracket 9 consisting of two essentially plate-shaped arms 9*a*, 9*b* enclosing a right angles with each other. First bracket arm 9*a* serves to hold mirror 1 while second bracket arm 9*b* defines a substantially flat support surface enabling the bracket to stand on, or to be hung from, a support. While the support surface is flat, it need not be continuous, being defined, for instance, in the illustrated embodiment, by the side walls of the second bracket arm forming a recess therebetween (see FIG. 3).

Figure 3:
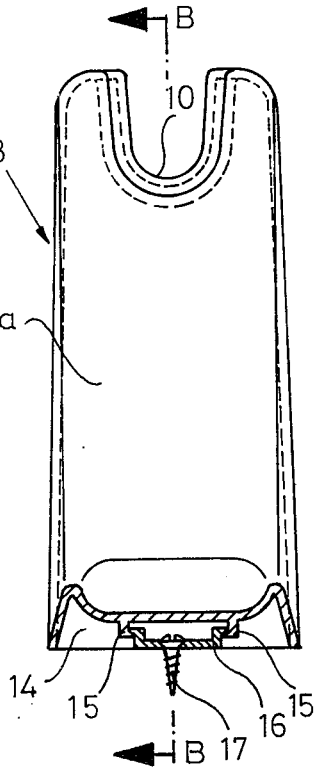
FIG. 3 is a front elevational view of the one bracket arm and a second along line A—A of FIG. 4 of the second bracket arm.

The free end of first bracket arm 9*a* defines an outwardly open, relatively deep recess 10, the handle end in the illustrated embodiment being of circular cross section and the open recess having a correspondingly circular bottom portion, as shown in FIGS. 2 and 3. Mirror handle 2 is received in recess 10 with a friction fit but rotatable about its axis. For this purpose, the circular handle end defines peripheral groove 3, which is relatively deep, and recess 10 has bead 11 fitting into the peripheral groove for engagement therewith, bead 11 constituting a guide rail for groove 3 when the handle is rotated about its axis while supported on holder 8.

While a circular cross section will be most convenient for the one handle end defining groove 3, the cross section of the remaining portion of the handle may be non-circular.

When the mirror and bracket are assembled, groove 3 is snapped onto bead 11, the dimensions of the groove and bead being such that engagement is easy but there is little play between the groove and the bead. To hold the mirror securely in holder 8 when the same is hung, for instance, resilient locking device 12 is arranged in recess 10 adjacent bead 11 for engaging a portion of the one handle end adjacent groove 3. This resilient locking or locating device may take any suitable form. In the illustrated embodiment, recess 10 is delimited by a portion of the wide wall of the hollow body forming first bracket arm 9*a*. The opposing sides of the wall of recess 10, which may be substantailly parallel or slightly inwardly tapering, as shown, define parallel slots P,P to form small strip S (FIGS. 2 and 4) which are elastic and slightly resilient. The strip have inwardly projecting noses N which narrow the passage at the open end of recess 10. When the one handle end is inserted into recess 10 so as to engage groove 3 with bead 11, handle portion 13 adjacent groove 3 presses against noses N and forces strips S apart. As soon as the handle end has fully entered recess 10 and groove 3 engages bead 11, noses N snap back and strips S are resiliently restored in their rest position so as to hold the handle end securely in holder bracket recess 10 while permitting it to be rotated about its axis.

It is advantageous to impart a rough surface to handle portion 13, such as giving it a knurled configuration, this handle portion being arranged engaging cooperation with locking or locating device 12.

Figure 4:
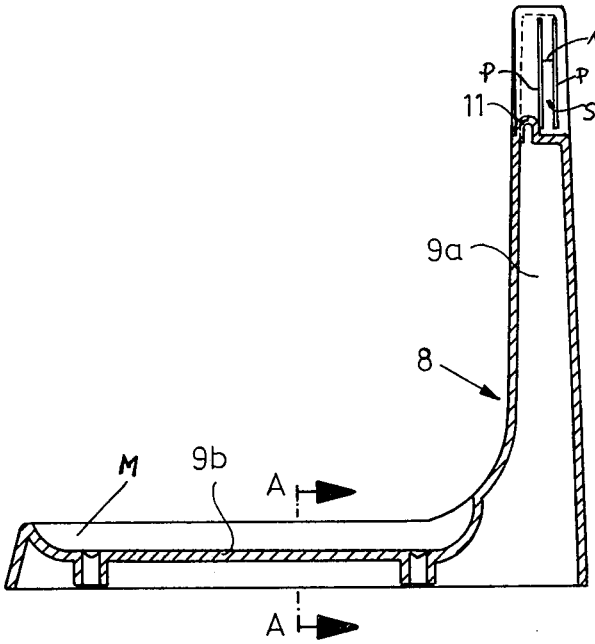
FIG. 4 is a section of the holder bracket along line B—B of FIG. 3.

As best shown in FIGS. 3 and 4, second bracket arm 9*b* defines a substantially flat support surface to enable the holder bracket to be placed on a horizontal flat support or to be hung from a wall. This support surface may be constituted by a flat plate or wall of the second bracket arm or by rectilinear side walls of the arm or feet extending therefrom, such side walls or feet defining a support surface engaging the flat wall on which the bracket holder stands or hangs. Since the mirror handle is securely held in the free end of the first bracket arm, as hereinabove described, it will remain therein, whether the holder bracket stands or hangs.

In the illustrated embodiment, the surface of second bracket arm 9*b* opposite its flat supporting surface defines trough M so that, when the mirror is used as a standing mirror, small utensils may be held in the trough of the holder.

As shown in FIG. 3, the illustrated embodiment of the mirror defines recess 14 housing fastening means for the holder bracket so that the same may be hung on a wall. The illustrated arrangement comprises guide 15 extending in the longitudinal direction of second bracket arm 9*b* in recess 14 and fastening element 16 is slidably mounted in the guide. The fastening element is secured to the wall by screw 17 and, when it is desired to hang the mirror, guide 15 of the bracket holder arm need only by slidably engaged with the fastening element to hang the mirror.

I claim:

1. A mounting for a mirror held in a frame for selective use as a hand mirror, standing mirror and wall mirror, comprising the combination of

1. a handle having one end attached to the mirror frame, a. the one handle end defining a relatively deep peripheral groove,

2. a holder bracket consisting of two essentially plate-shaped arms enclosing an angle with each other, a. a first one of the bracket arms having a free end defining an outwardly open recess adapted to receive the peripheral groove on the one handle end and to form a seat for this grooved handle end, b. a bead in the open recess, the bead fitting into the peripheral groove, c. a second one of the bracket arms defining a substantially flat support surface, and

3. a resilient locking device arranged in the recess for engaging a portion of the one handle end adjacent the groove.

2. The mirror mounting of claim 1, wherein the one handle end portion has a rough surface.

3. A mounting for a mirror held in a frame for selective use as a hand mirror, standing mirror and wall mirror, comprising the combination of

1. a handle having one end attached to the mirror frame, a. the one handle end defining a relatively deep peripheral groove,

2. a holder bracket consisting of two essentially plate-shaped arms enclosing an angle with each other, a. a first one of the bracket arms having a free end defining an outwardly open recess adapted to receive the peripheral groove on the one handle end and to form a seat for this grooved handle end, and b. a second one of the bracket arms defining a substantially flat support surface, the flat support surface defining a recess, and

3. a fastening means arranged in the recess of the surface.

4. The mirror mounting of claim 3, wherein the one handle end is of circular cross section and the open recess has a correspondingly circular bottom portion.

5. The mirror mounting of claim 3, further comprising a bead extending radially into the open recess, the bead defining a shoulder in the recess and fitting into the peripheral groove.

6. The mirror mounting of claim 3, further comprising a guide arranged in the recess of the surface and extending in the longitudinal direction of the second bracket arm, and a fastening element slidably mounted in the guide for fastening the holder bracket to a wall.

* * * * *